US006915777B2

(12) United States Patent
Fukushima et al.

(10) Patent No.: US 6,915,777 B2
(45) Date of Patent: Jul. 12, 2005

(54) CONTROL SYSTEM FOR GENERAL-PURPOSE ENGINE

(75) Inventors: Tomoki Fukushima, Wako (JP); Takao Tamechika, Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 216 days.

(21) Appl. No.: 10/246,480

(22) Filed: Sep. 19, 2002

(65) Prior Publication Data

US 2003/0056753 A1 Mar. 27, 2003

(30) Foreign Application Priority Data

Sep. 20, 2001 (JP) ..... 2001-287323
Sep. 20, 2001 (JP) ..... 2001-287324
Sep. 20, 2001 (JP) ..... 2001-287325
Sep. 20, 2001 (JP) ..... 2001-287326

(51) Int. Cl.[7] ..... F02D 41/14; F02D 41/22
(52) U.S. Cl. ..... 123/335; 123/352
(58) Field of Search ..... 123/335, 352–355; 701/110

(56) References Cited

U.S. PATENT DOCUMENTS 4,987,870 A * 1/1991 Koiwa et al. ..... 123/335
5,235,512 A * 8/1993 Winkelman et al. ..... 123/352
5,524,588 A 6/1996 Dykstra et al. ..... 123/353
5,558,062 A * 9/1996 De Minco et al. ..... 123/361
5,629,568 A 5/1997 Mertens ..... 290/40 R
5,884,613 A 3/1999 Kitamura et al. ..... 123/696
6,390,061 B1 5/2002 Melville et al. ..... 123/353
6,688,283 B2 * 2/2004 Jaye ..... 123/352

FOREIGN PATENT DOCUMENTS

DE 43 15 362 A 11/1994
EP 0 393 642 A2 10/1990
EP 0 393 642 A3 10/1999
EP 1 046 800 A3 10/2000
EP 1 046 800 A2 10/2000
JP 62-26501 * 2/1987
JP 10-103131 4/1998

* cited by examiner

*Primary Examiner*—Tony M. Argenbright
(74) *Attorney, Agent, or Firm*—Westerman, Hattori, Daniels & Adrian, LLP

(57) ABSTRACT

A control system for general-purpose spark-ignition internal combustion engine to be used for a portable generator, etc., having one or two cylinders and an actuator connected to the throttle valve to open or close the throttle value. In the system, an adaptive controller with a parameter identification mechanism is provided which receives a detected engine speed and a desired engine speed as inputs, and computes a command value to be supplied to the actuator, using an adaptive parameter identified by the parameter identification mechanism, such that the detected engine speed is brought to the desired speed. In the system, the desired engine speed is determined such that the desired engine speed per unit time is not greater than a prescribed value and the command value is determined to be within the upper and lower limits of the throttle value.

26 Claims, 10 Drawing Sheets

CONTROL SYSTEM FOR GENERAL-PURPOSE ENGINE

BACKGROUND OF THE INVENTION

1. Field of the Invention

This invention relates to a control system for a general-purpose engine.

2. Description of the Related Art

The general-purpose engine is a well-known spark-ignition internal combustion engine with not more than two cylinders that sucks into the cylinders, ignites and burns an air-fuel mixture produced in a carburetor by mixing gasoline fuel and an amount of intake air regulated by a throttle valve. General-purpose engines are used as power sources for portable generators, agricultural machines, civil engineering equipment and various other kinds of machinery.

Since general-purpose engines of this type are desirably rugged and inexpensive, they use a carburetor-type fuel supply system and are started manually with a recoil starter. As they are intended for use in a fixed engine speed range, their speed is usually controlled using a mechanical governor comprising weights and a spring.

Still, even in this type of general-purpose engine, the recent trend in development is toward introduction of PID control of the throttle valve using a linear solenoid, stepper motor or other actuator connected to the throttle valve and a microcomputer-based electronic control unit (ECU) for producing the actuator command values.

Further, while not for general-purpose engines but for vehicle internal combustion engines, Japanese Laid-open Patent Application No. 10(1999)-103131, for example, teaches a technology for controlling air-fuel ratio using an adaptive controller.

Although the mechanical governor is cheap because it does not need an electric power supply, it has difficulty maintaining a constant engine speed irrespective of the magnitude of the load and requires the characteristic of the spring to be set in accordance with the engine type and/or the engine speed range during use. Moreover, when an actuator is connected to the throttle valve and the actuator command values are determined using a PID control law, the PID control gain has to be set according to the load such as the generator and some similar parameters. Then when the utilized engine speed range is changed, the gain has to be reset. In other words, when control is conducted using a PID control law, optimum stability and tracking property is not ensured when a characteristic of the subject of control (plant) changes.

In contrast, when actuator command values are set using an adaptive control law, the amount of computation increases, but, owing to the fact that the gain can be set without taking load into account, robust control can be achieved with respect to changes in a characteristic of subject of control (plant). Another advantage is that the utilized engine speed can be set freely.

Thus, the application of the adaptive control to such a general-purpose engine has long been desired.

Further, when such adaptive control is applied to an actual general-purpose engine, overshooting of the desired value or control hunting is liable to occur owing to the fact that response to sudden step-like changes in the desired value is impossible because the input value is limited by the throttle opening limit and, further, that the fuel control responsivity or response is low because of the operational delay of the fuel supply system carburetor.

Further, when such adaptive control is applied to an actual general-purpose engine, since the throttle valve of the actual engine has physical upper and lower limits, when a computed command value becomes out of the limits, the control is made impossible.

Further, when such adaptive control is applied to an actual general-purpose engine, since this type of engine has a single or two cylinders, it is difficult to build a stable control system because the engine speed (indicative of the behavior of the engine to be controlled) is liable to fluctuate markedly under the influence of the combustion cycle composed of intake, compression, expansion and exhaust strokes.

Furthermore, when such adaptive control is applied to an actual general-purpose engine, if a gain (that determines a convergence or identification speed of the adaptive controller) is set high, the engine speed would be unstable near the desired engine speed when suffered from a disturbance. On the other hand, when the gain is set low, the responsivity of control would be degraded when the characteristic of the plant (engine) fluctuates due to the change in load or some similar factors.

SUMMARY OF THE INVENTION

A first object of the invention is therefore to overcome the foregoing problems by providing a control system for a general-purpose spark-ignition internal combustion engine having one or two cylinders and an actuator connected to the throttle valve, which introduces an air-fuel mixture produced in a carburetor by mixing gasoline fuel and intake air regulated by the throttle valve into the cylinder to be ignited, which utilizes an adaptive controller to compute an command value for the actuator to open or close the throttle valve.

A second object of the invention is to provide a control system for a general-purpose spark-ignition internal combustion engine having one or two cylinders and an actuator connected to the throttle valve, which introduces an air-fuel mixture produced in a carburetor by mixing gasoline fuel and intake air regulated by the throttle valve into the cylinder to be ignited, which utilizes an adaptive controller to compute an command value for the actuator, while preventing overshooting of the desired value and/or control hunting even when the input value has a limit.

A third object of the invention is to provide a control system for a general-purpose spark-ignition internal combustion engine having one or two cylinders and an actuator connected to the throttle valve, which introduces an air-fuel mixture produced in a carburetor by mixing gasoline fuel and intake air regulated by the throttle valve into the cylinder to be ignited, which utilizes an adaptive controller to compute an command value for the actuator, while enabling to determine an output command value obtained from the computed value within physical upper and lower limits of the throttle valve, thereby ensuring to achieve a robust control.

A fifth object of the invention is to provide a control system for a general-purpose spark-ignition internal combustion engine having one or two cylinders and an actuator connected to the throttle valve, which introduces an air-fuel mixture produced in a carburetor by mixing gasoline fuel and intake air regulated by the throttle valve into the cylinder to be ignited, which utilizes an adaptive controller to compute an command value for the actuator, without being affected by the fluctuation of the engine speed, thereby ensuring to achieve a stable control.

A sixth object of the invention is to provide a control system for a general-purpose spark-ignition internal combustion engine having one or two cylinders and an actuator connected to the throttle valve, which introduces an air-fuel mixture produced in a carburetor by mixing gasoline fuel and intake air regulated by the throttle valve into the cylinder to be ignited, which utilizes an adaptive controller to compute an command value for the actuator, while determining the gain that determines the convergence speed of the adaptive controller appropriately such that the convergence and responsivity of control are optimally balanced.

For achieving these objects, the invention provides a system for controlling a general-purpose spark-ignition internal combustion engine having one or two cylinders and an actuator connected to the throttle valve to open or close the throttle value, which introduces an air-fuel mixture produced in a carburetor by mixing gasoline fuel and intake air regulated by the throttle valve into the cylinder to be ignited, comprising engine speed detecting means for detecting a speed of the engine; desired engine speed determining means for determining a desired speed of the engine; an adaptive controller with a parameter identification mechanism, which receives the detected engine speed and the desired engine speed as inputs, and computes a command value to be supplied to the actuator, using an adaptive parameter identified by the parameter identification mechanism, such that the detected engine speed is brought to the desired speed; and command value determining means for determining an output command value based on the command value computed by the adaptive controller and supplying the output command value to the actuator.

In the system, the desired engine speed determining means determines the desired engine speed such that the desired engine speed per unit time is not greater than a prescribed value.

In the system, the command value determining means includes; first comparing means for comparing the command value with a first predetermined value and when the command value is greater than the first predetermined value, for replacing the command value by the first prescribed value; second comparing means for comparing the command value with a second predetermined value and when the command value is smaller than the second predetermined value, for replacing the command value by the second predetermined value; and determines at least one of the replaced value and the computed command value as the output command value.

The system includes a crank angle sensor provided at the engine which generates output at predetermined crank angle intervals; and smoothed value calculating means for calculating a smoothed value of the outputs of the crank angle sensor for a predetermined number of the outputs; and detects the engine speed based on the smoothed value.

The system further includes gain determining means for determining a gain that determines an identification speed of the adaptive parameter based on a deviation of the detected engine speed and the desired engine speed.

BRIEF DESCRIPTION OF THE DRAWINGS

The objects and advantages of the invention will be made apparent with reference to the following descriptions and drawings, in which.

DETAILED DESCRIPTION OF THE PREFERRED EMBODIMENT

A control system for a general-purpose engine according to an embodiment of this invention will now be explained with reference to the drawings.

Figure 1:
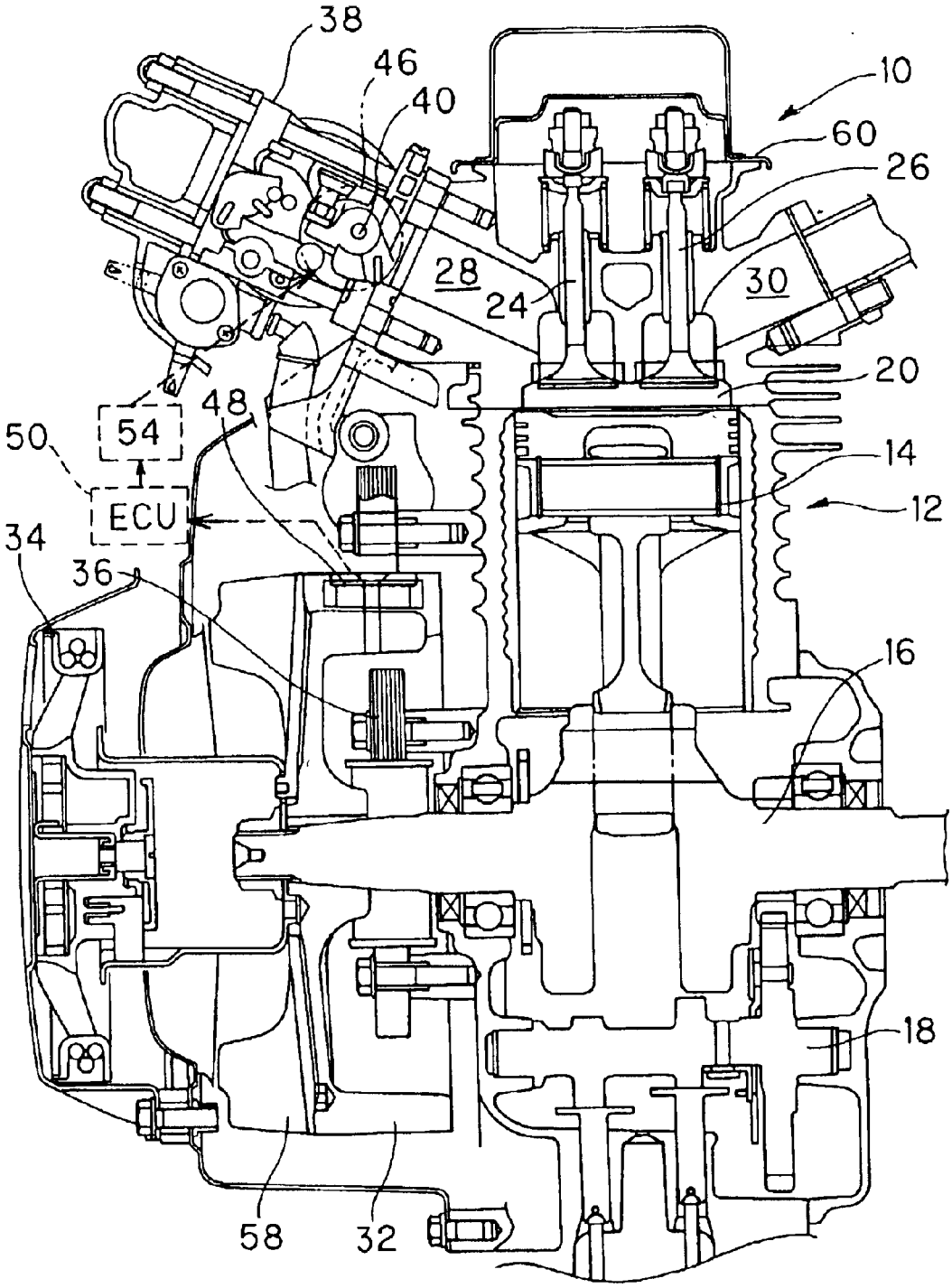
FIG. 1 is an overall schematic diagram showing a control system for a general-purpose engine according to an embodiment of this invention.

FIG. 1 is an overall schematic diagram showing the control system for a general-purpose engine.

In FIG. 1, reference numeral 10 designates a general-purpose engine (hereinafter referred to simply as the "engine"). The engine 10 is a water-cooled, four-cylinder OHV model with a displacement of 196 cc. The engine 10 has a single cylinder 12 accommodating a piston 14 that can reciprocate therein. The piston 14 is connected to a crankshaft 16 and the crankshaft 16 is connected to a camshaft 18 through a gear (not shown).

A combustion chamber 20 is formed between the head of the piston 14 and the cylinder wall. An intake valve 24 and an exhaust valve 26 are installed in the cylinder wall for opening the combustion chamber 20 to and closing it off from an air intake passage 28 and an exhaust passage 30. A flywheel 32 is attached to the crankshaft 16 and a recoil starter 34 is attached to the outer side of the flywheel 32 for use by the operator when starting the engine 10. A generator coil (alternator) 36 is installed on the inner side of the flywheel 32 for generating alternating current. The generated alternating current is converted to direct current by a rectifier circuit (not shown) and supplied to a spark plug (not shown) etc.

A carburetor 38 is installed upstream of the air intake passage 28 along with a throttle valve 40 formed integrally with the carburetor 38. (In FIG. 1, the throttle valve 40 is represented by its shaft on which the throttle plate is fixed.) The carburetor 38 is connected to a fuel tank (not shown) through a fuel line (not shown). It is supplied with fuel stored in the fuel tank and produces an air-fuel mixture by jetting gasoline fuel into intake air through a nozzle (not shown). The so-produced air-fuel mixture flows in the downstream direction of the air intake passage 28 to be sucked into the combustion chamber 20 of the cylinder 12 through the intake valve 24.

The throttle valve 40 is connected to a stepper motor (actuator) 46 supplied with command values (angular steps) to operate so as to open/close the throttle valve 40 according to the command values. In FIG. 1, the stepper motor 46 is represented by a phantom line because it is situated behind the carburetor 38.

A crank angle sensor (engine speed sensor) 48 composed of a magnetic pickup is provided in the vicinity of the flywheel 32 and outputs pulses (i.e., generates outputs) at crank angle intervals of 12 degrees. Thus the crank angle sensor 48 produces 30 pulses per revolution of the crankshaft (per crank angle of 360 degrees) or 60 pulses per revolution of the camshaft (per crank angle of 720 degrees).

An encased ECU (Electronic Control Unit) 50 is installed at an appropriate part of the engine 10. The output of the crank angle sensor 48 is sent to the ECU 50. The ECU 50 is constituted as a microcomputer equipped with a CPU, ROM, RAM and a counter. The output pulses of the crank angle sensor 48 are inputted to the counter in the ECU 50 to be counted and used to detect or determine the engine speed NE.

Based on the detected engine speed etc., the ECU 50 conducts adaptive control computation (computation using an adaptive control law comprising an adaptive controller and a parameter identification mechanism; explained later), determine or calculates a command value for the stepper motor (actuator) 46 so as to bring the detected engine speed to the desired engine speed, and operates the stepper motor 46 by outputting the command value thereto through a motor driver 54 mounted adjacent to the ECU 50 in the same case. The engine 10 is connected to a portable generator (not shown) as a load. Reference numerals 58 and 60 in FIG. 1 designate a cooling fan and a head cover.

Figure 2:
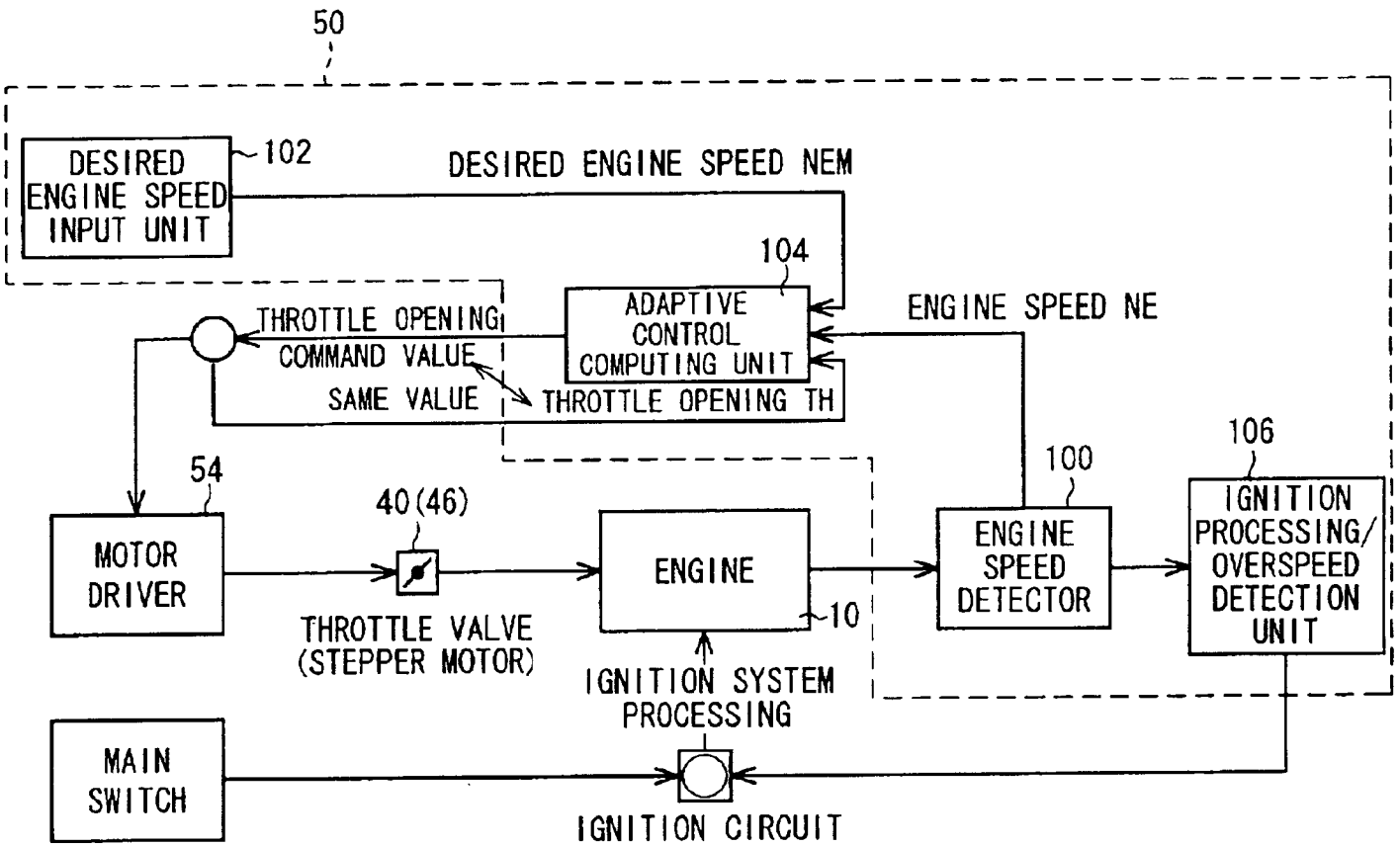
FIG. 2 is a block diagram functionally showing the operation of an ECU of the system of FIG. 1.

FIG. 2 is a block diagram functionally showing the operation of the ECU 50.

As illustrated, the ECU 50 conducts adaptive control computation in an adaptive control computing unit 104 based on the engine speed NE detected in an engine speed detector (engine speed detecting means) 100, a desired engine speed NEM inputted from a desired engine speed input unit 102 and the like, thereby calculating a command value (throttle opening command value). The ECU 50 uses to operate the stepper motor 46 through the motor driver 54 so as to open/close the throttle valve 40.

The output of the engine speed detector 100 is sent to an ignition processing/overspeed detection unit 106 that conducts ignition processing and overspeed detection. The ignition processing, conducted with a main SW (switch) ON, involves supplying the output of the rectifier circuit to the primary of an ignition coil (not shown) to initiate current flow at a prescribed crank angle, cutting off the current flow at a prescribed crank angle (e.g., BTDC 10 degrees) to produce a high voltage in the secondary, and igniting the air-fuel mixture in the combustion chamber 20 of the cylinder 12 by means of the spark plug. The main SW is a switch for supplying operating power to the ECU 50. It is not shown in the drawings.

The ignition is thus conducted at a fixed ignition timing and the engine 10 is not equipped with a battery. The ignition processing/overspeed detection unit 106 compares the detected engine speed NE with an upper limit value and when the detected engine speed exceeds the upper limit value, determines that an overspeed state has arisen and cuts off (discontinues) ignition to stop the engine 10.

Although a single cylinder engine is shown as the engine 10 in FIG. 1, the control system for a general-purpose engine of this embodiment is also appropriate for application to a two-cylinder general-purpose engine. That is to say, the control system for a general-purpose engine of this embodiment is premised on application to a general-purpose engine having not more than two cylinders.

The adaptive control computation conducted by the adaptive control computing unit 104 will now be explained.

Figure 3:
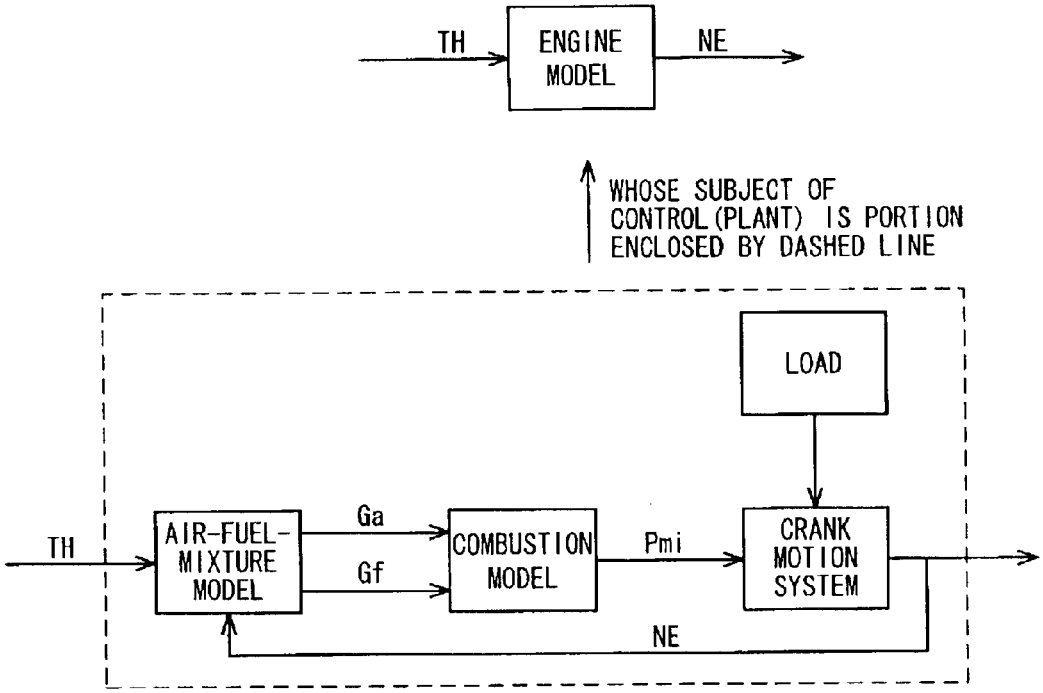
FIG. 3 is a block diagram showing the engine of FIG. 1 reduced to a simple model.

FIG. 3 shows a simplified model of the engine 10 inputted with a throttle opening TH. During adaptive control, the portion enclosed by a broken line is considered an engine model and treated as a single block. In FIG. 3, Ga means the air mass flow, Gf means the fuel mass flow, and Pmi means an output comprising the product of the mass m and inertia I arising in the piston 14.

The object of the control is compute and adjust the throttle opening TH constituting the input such that the engine speed NE, i.e., the output from the plant (engine model) is brought to or is becomes equal to the desired value (the desired engine speed NEM). Since the load variation is basically an unknown parameter, the parameters of the combustion model of the engine 10, including the load (e.g., portable generator), need to be successively computed.

Figure 4:
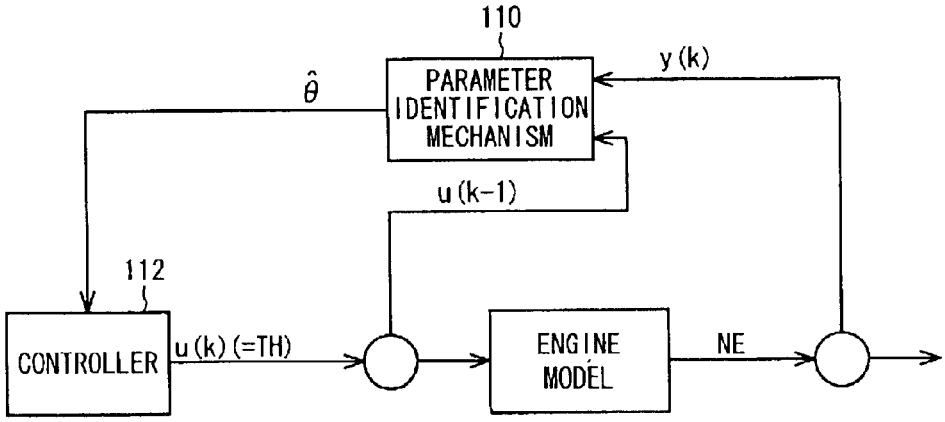
FIG. 4 is a block diagram showing the structure of an STR (Self-Tuning Regulator) used in the system of FIG. 1.

Specifically, an STR (Self-Tuning Regulator) configured as shown in FIG. 4 is used to structure a control model whose plant is the engine model enclosed by the broken line in FIG. 3. In FIG. 4, a parameter identification mechanism 110 uses the throttle opening TH inputted to the plant as the manipulated variable and the engine speed NE outputted therefrom as the controlled variable and identifies or estimates an engine model parameter (adaptive parameter) θ-hat of the engine model such that even the load variation is compensated. The "hat" indicating an estimated value.

Next, a controller (adaptive controller) 112 uses the identified parameter to correct the throttle opening TH in such a way that the difference between the desired engine speed NEM and the engine speed NE becomes zero. By successively repeating the foregoing, the throttle opening TH can be regulated so as to bring the engine speed NE to the desired engine speed NEM.

The adaptive control of the system according to this embodiment will now be concretely explained with reference to FIG. 4. The adaptive control itself is known.

The illustrated plant (engine model) is generally represented as a single-input, single-output linear discrete time system as shown by Equation 1.

$$A(q)y(k)=B(q)u(k)+w(k) \qquad \text{Eq. 1}$$

In Equation 1, A, B: coefficient matrices representing plant transfer function; y(k); plant output (controlled variable, i.e., engine speed) at time k; u(k) plant input (manipulated variable, i.e., throttle opening TH, more specifically, stepper motor command value (angular steps) at the time k; w(k): white noise at the time k.

It should be possible in this way to determine or calculate the value that the throttle opening needs to be adjusted to in order to obtain the desired engine speed. Actually, however, the load fluctuates greatly and in addition, the characteristic differs between different engines. It is therefore necessary to estimate the change in the characteristic.

In view of this, letting the desired engine speed be NEM ym(k), the known parameter (adaptive parameter) be θ and the known signal be ζ(k), and assuming the plant parameter to be unknown, θ is replaced by the observable parameter θ-hat, and the plant input u(k), i.e., the controller output, is determined or calculated by Equation 2. The symbol T indicates a transposed matrix.

$$u(k) = \frac{1}{\hat{b}_0(k)}\left\{y_{ref}(k+1) - \hat{\bar{\theta}}^T(k)\bar{\zeta}(k)\right\} \quad \text{Eq. 2}$$

In Equation 2, $b_0$ is a gain that determines a scalar amount. Here θ and ζ(k) are defined as shown by Equations 3.

$$\theta^T = [b_0, \bar{\theta}^T]$$
$$\zeta^T(k) = [u(k), \bar{\zeta}(k)] \quad \text{Eq. 3}$$

By this, change in characteristic can be observed or estimated even when the load of the engine 10 fluctuates or the engine itself differs. In the illustrated configuration, the parameter adjustment law is as shown by Equations 4 or 5.

$$\hat{\theta}(k) = \hat{\theta}(k-1) - \frac{\gamma\zeta(k-1)\varepsilon(k-1)}{\zeta^T(k-1)\zeta(k-1)}(2 > \gamma > 0) \quad \text{Eq. 4}$$
$$\hat{\theta}(k) = \hat{\theta}(k-1) - \Pi(k-1)\zeta(k-1)\varepsilon(k)$$

$$\Pi(k) = \frac{1}{\lambda_1(k)}\left[\Pi(k-1) - \frac{\lambda_2(k)\Pi(k-1)\zeta(k-1)\zeta^T(k-1)\Pi(k-1)}{\lambda_1(k) + \lambda_2(k)\zeta^T(k-1)\Pi(k-1)\zeta(k-1)}\right] \quad \text{Eq. 5}$$

When the parameter adjustment law indicated by Equation 5 is used, it is possible by selecting the variable gains λ1(k) and λ2(k) to select from among four algorithms: fixed gain algorithm, gradually-decreasing gain algorithm, least square method algorithm and fixed trace algorithm.

In this embodiment, the parameter adjustment law represented by Equation 4 is selected and, as explained in the following, the value of the convergence gain γ that determines the identification speed (convergence or adaptation speed) of the adaptive parameter θ is variably set in accordance with the engine speed deviation. The symbol ε in Equation 4 is a signal representing identification error.

Premised on the foregoing, the operation of the control system for a general-purpose engine of this embodiment will now be explained with reference to FIG. 5.

The illustrated program is executed in the ECU 50 when the engine 10 is manually started by the operator using the recoil starter 34 and its execution is repeated once every 10 msec thereafter.

First, in S10, it is checked whether the output voltage of the generator coil (alternator) 36 has risen to a value corresponding to the full-firing engine speed of engine 10, i.e., whether the engine 10 has started. It should be noted that the ECU 50 is activated at a lower voltage than the voltage corresponding to the full-firing engine speed and executes the illustrated program once every 10 msec.

When the result in S10 is NO, the remaining steps of the routine are skipped. When the result is YES, the program proceeds to S12, in which throttle position (opening) initialization processing is conducted. Specifically, a command value (angular steps) is outputted to the stepper motor 46 to drive the throttle valve 40 to a full-closed equivalent position, more specifically, to a full-closed equivalent position that, in consideration of possible sticking of the throttle valve 40, is an approximately two-degree open position, where wide open is defined as 0 degree and full closed as 90 degrees.

Next, in S14, the engine speed NE is detected or determined.

Figure 6:
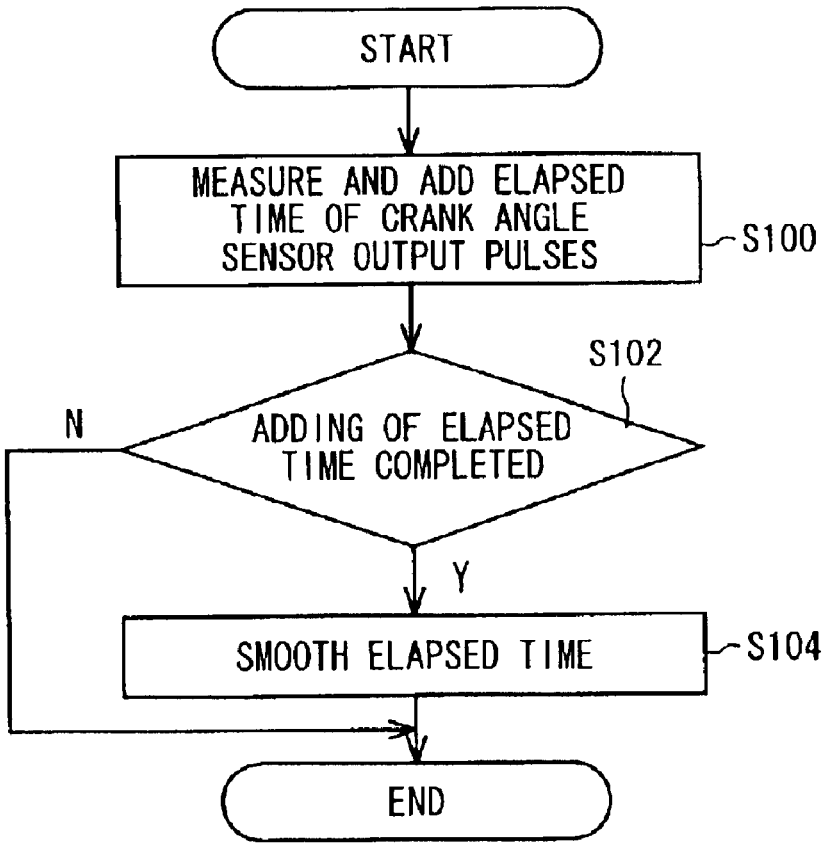
FIG. 6 is a subroutine flow chart showing the process for detecting or determining an engine speed in the flow chart of FIG. 5.

FIG. 6 is a subroutine flow chart showing the processing for this calculation.

Figure 7:
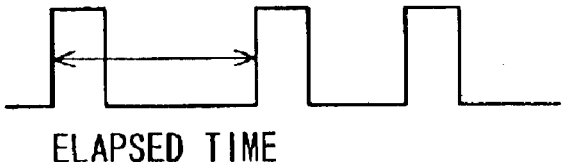
FIG. 7 is a diagram for explaining elapsed time summed in the flow chart of FIG. 6.

First, in S100, the elapse times of the output pulses of the crank angle sensor 48 are measured and progressively added. As shown in FIG. 7, the elapsed time is the time from the rise of one pulse to the rise of the next. Next, in S102, it is checked whether adding of elapsed times has been completed for the prescribed number (60) pulses. When the result is YES, the programs proceeds to S104, in which the output pulse elapsed time is smoothed.

Specifically, the engine speed NE is detected or determined by dividing the total value of the elapsed time by the prescribed number 60 to obtain the moving average value (smoothed value) of the pulse intervals. The reason for this will be explained. Since the engine 10 has only a single cylinder, it is difficult, when using an adaptive control law such as explained above for engine speed control, to structure a stable control system because the engine speed (that is the parameter to be observed) fluctuates markedly under the influence of the combustion cycle composed of intake, compression, expansion and exhaust strokes.

The engine speed is therefore smoothed by calculating the moving average of the output pulse intervals (rise-to-rise time intervals) once every time period corresponding to two crankshaft revolutions (crank angle of 720 degrees), i.e., corresponding to an integral multiple of combustion cycles (here one combustion cycle) of the engine 10.

Thus, the engine speed detector (or detecting unit) 100 includes the crank angle sensor 48 provided at the engine 10 which outputs signals at predetermined crank angle intervals, and smoothing means for smoothing outputs of the crank angle sensor for a predetermined number of the outputs, and detects the engine speed NE based on the smoothed value.

By this, the fluctuation owing to the intake, compression, expansion and exhaust strokes can be canceled out so that a more stable control system can be built than in the case of detecting the engine speed using instantaneous values. Although the integral multiple of combustion cycles is one time in the exemplified case, it can be n times (n≧2).

In the flow chart of FIG. 6, when the result in S102 is NO, S104 is skipped and the average value in the preceding cycle is used.

Figure 5:
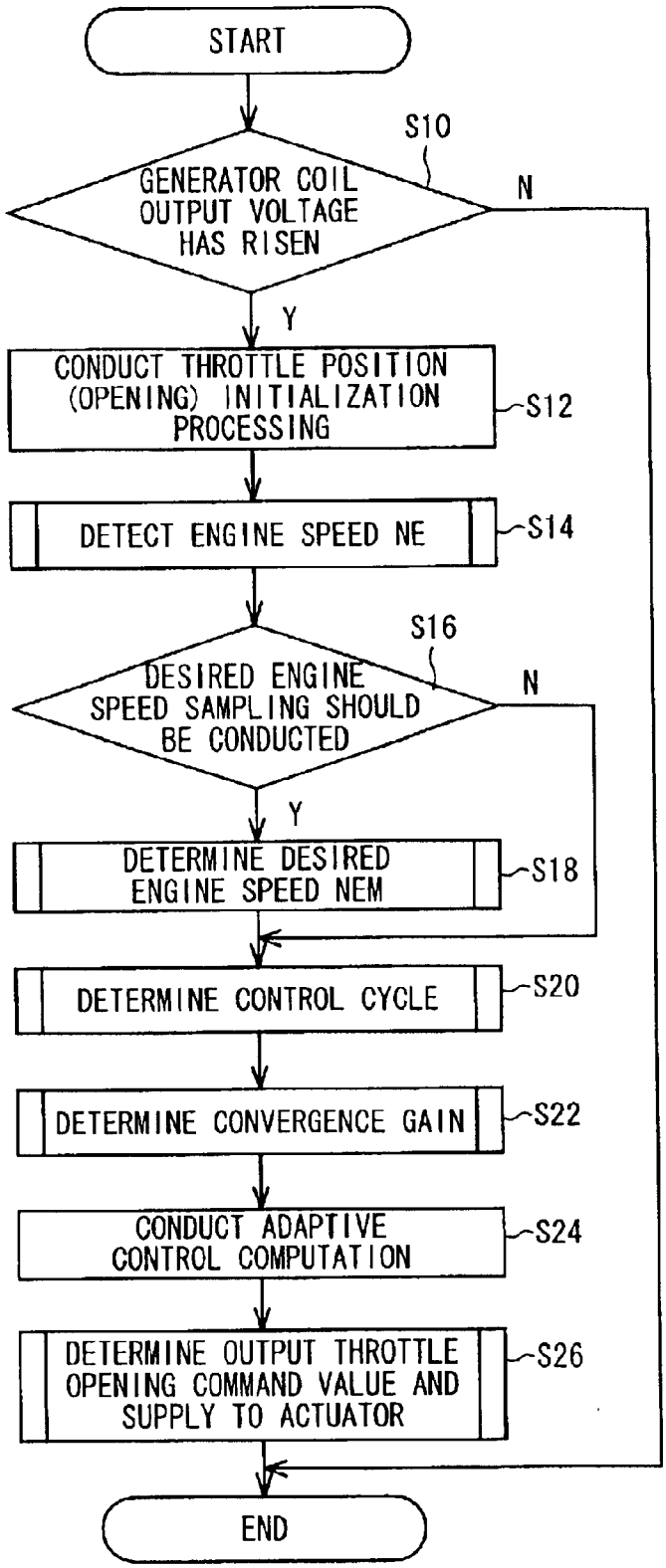
FIG. 5 is a flow chart showing the operation of the system of FIG. 1.

Next, in S16 of the flow chart of FIG. 5, it is checked whether sampling of the desired engine speed NEM should be conducted. This check is made because the program is executed once every 10 msec, the desired engine speed is read in (sampled) once very 100 msec, i.e., once every 10 executions, and when the desired engine speed is changed, the desired engine speed NEM is determined (corrected) accordingly. A check is therefore made in S16 to determine whether the current execution is one in which sampling should be conducted.

When the result in S16 is YES, the program proceeds to S18, in which desired engine speed NEM is determined or calculated. When the result in S16 is NO, S18 is skipped.

Figure 8:
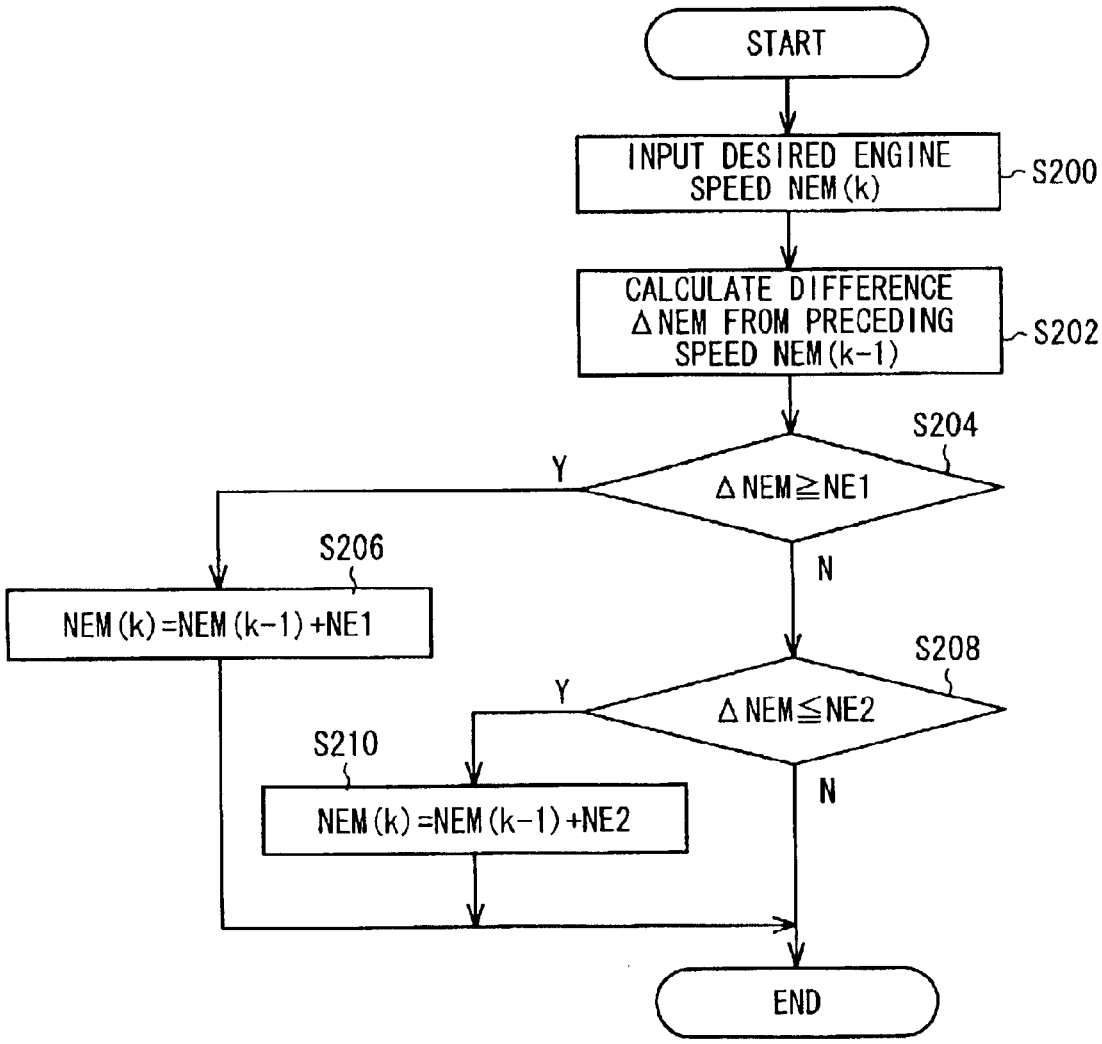
FIG. 8 is a subroutine flow chart showing the process for determining a desired engine speed in the flow chart of FIG. 5.

FIG. 8 is a subroutine flow chart showing the calculating process in S18.

First, in S200, the desired engine speed NEM is inputted. The inputted desired engine speed NEM is designated NEM(k). The desired engine speed NEM is the value inputted by the desired engine speed input unit 102 shown in FIG. 2. The input of the desired engine speed NEM is effected by reading the demand value inputted by the operator through a volume switch (not shown in FIG. 1). Optionally, the desired engine speed NEM can be stored in the ROM of the ECU 50 and read in this step.

Next in step S202, the desired engine speed NEM(k−1) in the preceding cycle (the value inputted when the flow chart of FIG. 5 was executed one cycle earlier) is subtracted from the inputted desired engine speed NEM(k) to calculate the difference ΔNEM. Next, in S204, it is checked whether the calculated difference ΔNEM is equal to or greater than a prescribed value NE1 (300 rpm; positive value). In other words, it is checked whether an increase equal to or greater than the prescribed value NE1 has been demanded or requested. When the result is YES, the program proceeds to S206, in which the sum obtained by adding the prescribed value NE1 to the desired engine speed NEM(k−1) in the preceding cycle is defined as the desired engine speed NEM(k) in the current cycle.

When the result in S204 is NO, the program proceeds to S208, in which it is checked whether the calculated difference ΔNEM is equal to or greater than a second prescribed value NE2 (−100 rpm; negative value). In other words, it is checked whether a decrease exceeding the second prescribed value NE2 (negative value) has been demanded. When the result is YES, the program proceeds to S210, in which the difference obtained by adding, more precisely subtracting, the second prescribed value NE2 from the desired engine speed NEM(k−1) in the preceding cycle is defined as the desired engine speed NEM(k) in the current cycle.

In this manner, the change in the desired engine speed per unit time is determined so as not to be greater than a prescribed value. Specifically, the amount of increase per 100 msec determined in response to an engine speed increase demand is made not greater than a maximum of 300 rpm and the amount of decrease per 100 msec determined in response to a decrease demand is made not greater than a maximum of 100 rpm.

The reason for setting the increase direction value NE1 greater (in absolute value) than the decrease direction value NE2 is that in the illustrated general-purpose engine 10 it takes longer to increase the engine speed by a given amount than to decrease it by the same amount. The amount of change in the desired engine speed is therefore also set greater on the decrease direction. NE1 and NE2 are determined by experimental results based on the type or nature of engine and load.

The processing of FIG. 8 is implemented in view of the fact that, as was pointed out earlier, when adaptive control such as the foregoing is applied to an actual engine (the engine 10), overshooting of the desired engine speed or control hunting is liable to occur owing to the fact that response to sudden step-like changes in the desired value is impossible because the inputted value is limited by the throttle opening limit and, further, that the fuel control responsivity is low because of the operational delay of the carburetor 38.

Figure 9:
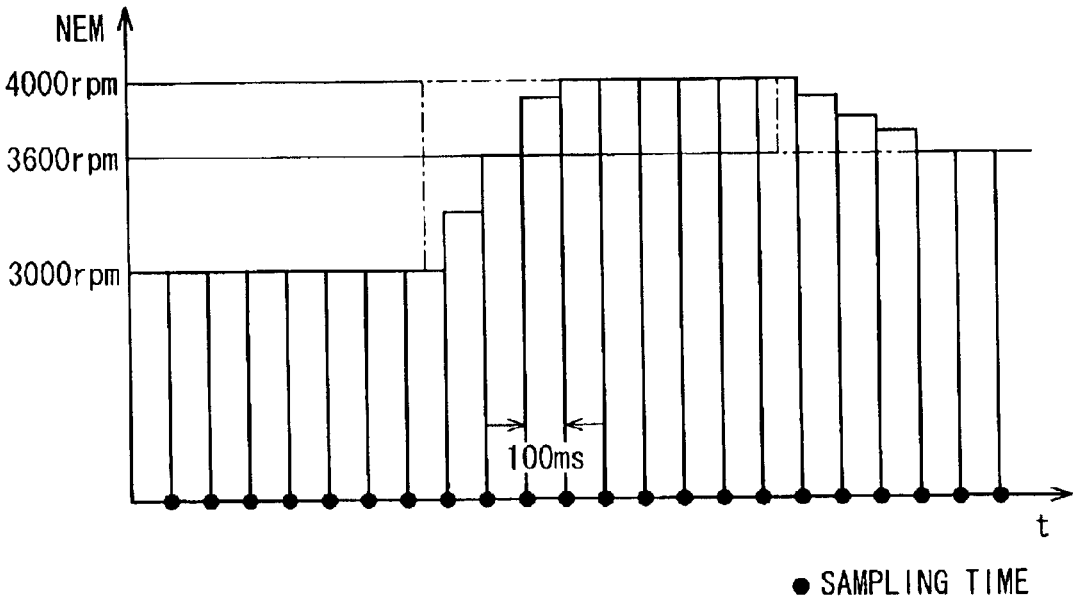
FIG. 9 is a time chart for explaining the processing of the flow chart of FIG. 8.

The engine speed change per unit time (100 msec) is therefore limited and the change is made gradually. That is, as shown in FIG. 9, the desired engine speed is not changed in sudden steps like those indicated by the alternate long and short dashed lines but is changed gradually as indicated by the solid lines. As a result, despite the low responsivity of the fuel control owing to the use of the carburetor 38, no overshooting of the change in the desired engine speed or control hunting occurs.

In addition, the prescribed values NE1 and NE2 are set to different values in the engine speed increase and decrease directions, and that in the increase direction is set greater. Approximately the same responsivity can therefore be obtained with respect to both desired engine speed increase and decrease demands. The matching of the prescribed values NE1 and NE2 to the engine responsivity in this way makes it possible to achieve improved control accuracy.

Next, in S20 of the flow chart of FIG. 5, the control cycle is determined or calculated.

Figure 10:
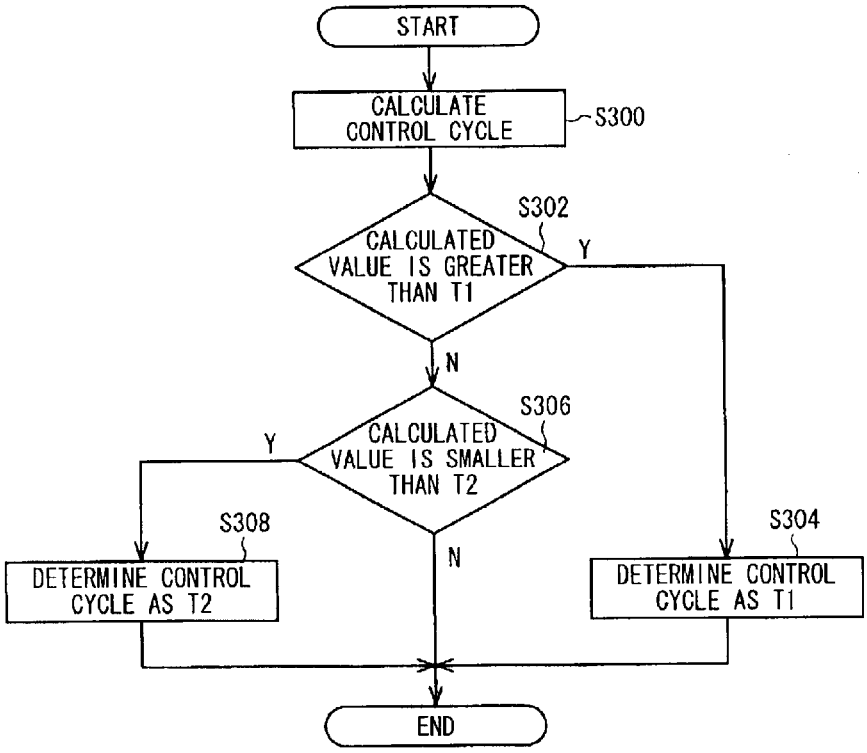
FIG. 10 is a subroutine flow chart showing the process for determining a control cycle in the flow chart of FIG. 5.

FIG. 10 is a subroutine flow chart showing the determining process in S20.

Before going into an explanation of this calculating process, the reason for conducting it will be explained. When an adaptive control law is used in the engine speed control of the engine 10, cases in which the control system becomes unstable may arise if the control cycle is constant. Specifically, as pointed out earlier, the engine speed fluctuation cycle of a one-cylinder general-purpose engine is strongly dependent on the combustion cycle composed of intake, compression, expansion and exhaust strokes. The time point for driving the throttle valve 40 is therefore preferably set prior to the intake stroke or at least synchronized with the combustion cycle.

Accordingly, in this embodiment the optimum control cycle at each engine speed is experimentally determined in advance and the control cycle is varied in accordance with the detected engine speed NE.

The flow chart of FIG. 10 will now be explained. The control cycle is calculated in S300. The control cycle is calculated as the quotient of dividing 60,000 [msec] by the detected engine speed NE. In other words, the control cycle is computed by dividing one minute by the engine speed.

Next, in S302, it is checked whether the calculated value is greater than a prescribed value T1 (60 msec). When the result is YES, the program proceeds to S304, in which the control cycle is determined or defined as prescribed value T1. When the result in S302 is NO, the program proceeds to S306 in which it is checked whether the calculated value is smaller than a second prescribed value T2 (10 msec). When the result is YES, the program proceeds to S308, in which the control cycle is determined or defined as the second prescribed value T2. When the result in S306 is NO, S308 is skipped.

Since the control cycle is thus varied in accordance with the detected engine speed NE, it is possible to set the control cycle to that optimum for the engine speed so as to realize a stable control system from the lowest to the highest speed of the illustrated general-purpose engine 10.

Next, in S22 of the flow chart of FIG. 5, the convergence gain of the adaptive control is determined or calculated. The convergence gain is the value represented by γ in Equation 4.

Figure 11:
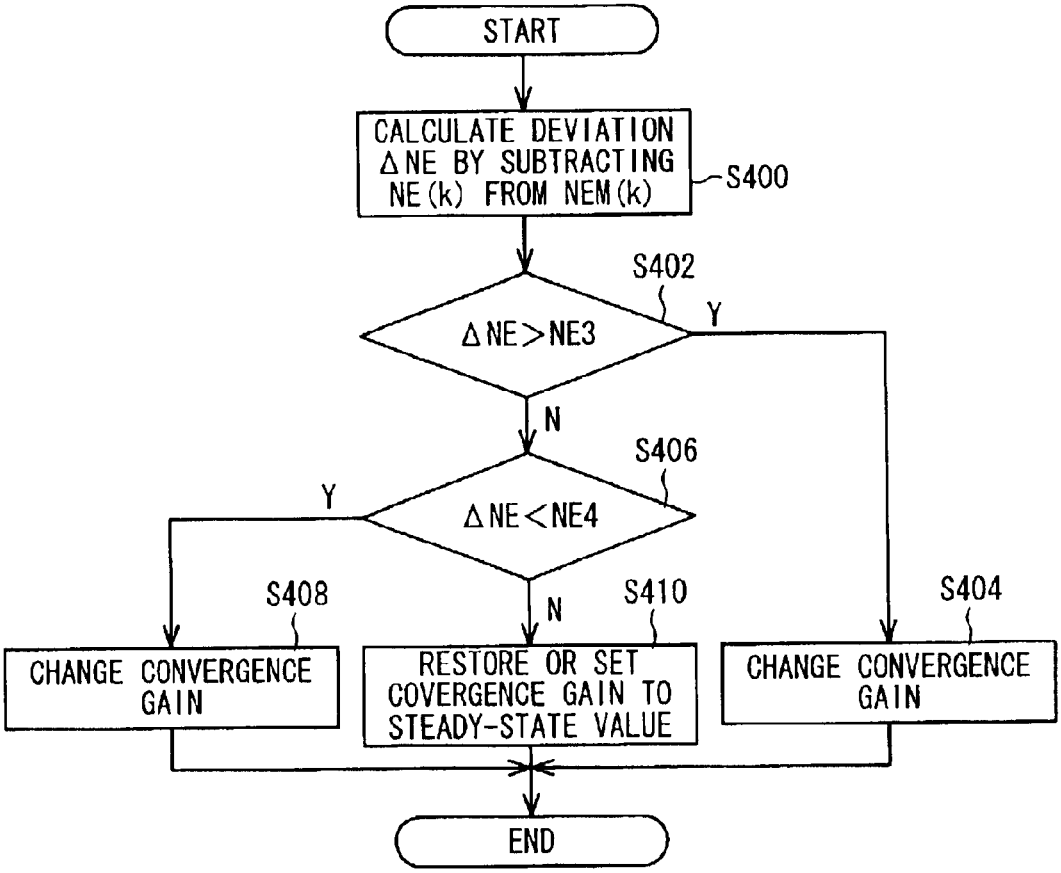
FIG. 11 is a subroutine flow chart showing the process for determining an adaptive control convergence gain $\gamma$ in the flow chart of FIG. 5.

FIG. 11 is a subroutine flow chart showing the determining process in S20.

Before going into an explanation of this calculating process, the reason for conducting it will be explained. When the speed of a general-purpose engine such as the illustrated one is adaptively controlled and the convergence gain is set high in order to enhance convergence on the desired engine speed, the engine speed becomes unstable if a disturbance is experienced.

On the other hand, when the convergence gain is set low to give precedence to stability, convergence degenerates when the plant characteristic changes markedly owing to load fluctuation or the like. In this embodiment, therefore, the convergence gain is made variable and is (by calculation) set low when the engine speed deviation is small but set high at other times.

The flow chart of FIG. 11 will now be explained. First, in S400, the detected engine speed NE(k) is subtracted from the desired engine speed NEM(k) to obtain the deviation ΔNE. Next, in S402, it is checked whether the calculated deviation ΔNE is greater than a prescribed value (first reference value) NE3 (300 rpm; positive value).

When the result in S402 is YES, the program proceeds to S404, in which the convergence gain is changed. Specifically, when the detected engine speed NE is near the desired engine speed NEM (determined or defined as the steady-state), the convergence gain is set at 0.9. The fact that the result in S402 is YES means that the detected engine speed is not near the desired engine speed but considerably below it. The convergence gain is therefore set to a greater value than in the normal state, namely, to 1.5.

When the result in S402 is NO, the program proceeds to S406, in which it is checked whether the calculated deviation ΔNE is greater than a second prescribed value (second reference value) NE4 (−300 rpm; negative value), i.e., whether the deviation ΔNE exceeds the second prescribed value NE4 in the negative direction. When the result is YES, the program proceeds to S408, in which the convergence gain is changed. Specifically, since the detected engine speed is not near but considerably higher than the desired engine speed, the convergence gain is set to a greater value than in the steady-state, namely, to 1.2. When the result in S406 is NO, the program proceeds to S410, in which the convergence gain is restored to or determined as the steady-state value of 0.9.

The reason for setting the gain of S408 smaller than the gain of S404 is that, as mentioned earlier, it takes less time to decrease the engine speed. Thus, in this embodiment, the convergence gain is made variable, and is calculated (set) to be low when the engine speed deviation is small and to be high otherwise. An optimum balance between convergence and stability can therefore be achieved in the engine speed control of the general-purpose engine.

Moreover, when the detected engine speed is below the desired engine speed (is deficient), the convergence gain is set higher than when the detected engine speed exceeds the desired engine speed. Convergence on the desired value can therefore be achieved in about the same amount of time as when the detected engine speed is higher than the desired engine speed.

Next, in S24 of the flow chart of FIG. 5, adaptive control computation is conducted. In concrete terms, this amounts to using Equation 2 to compute the controller output (plant input) u(k) in number of angular steps).

Next, in S26, output throttle opening command determination processing is conducted, i.e., an output command value to be supplied to the stepper motor 46 is determined and is then supplied to the stepper motor 46 through the motor driver 54.

Figure 12:
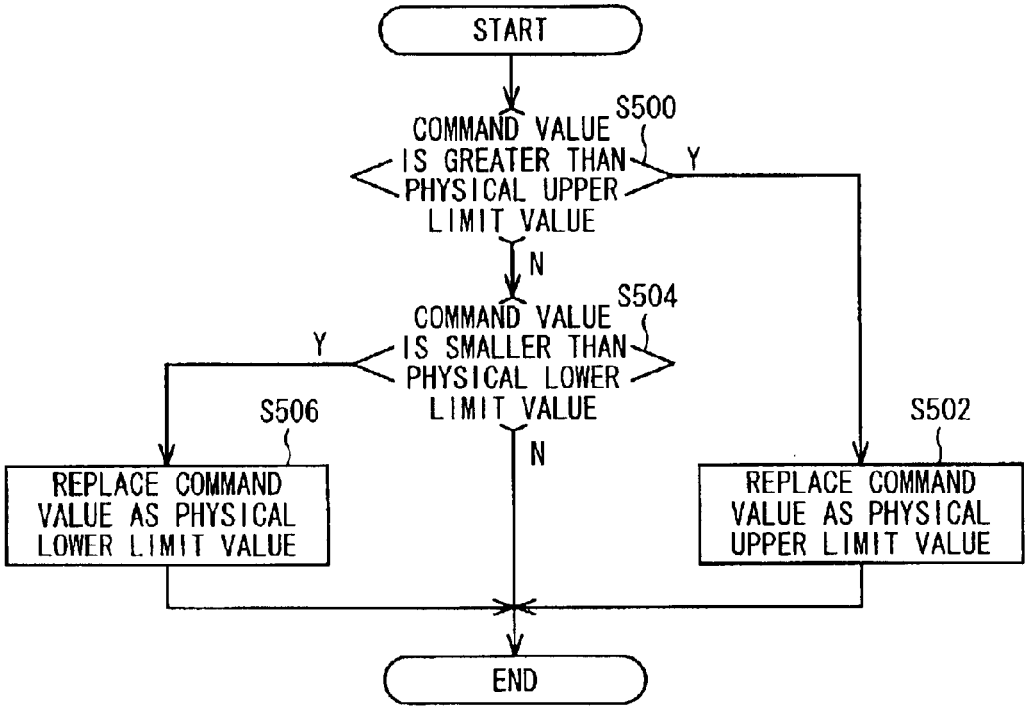
FIG. 12 is a subroutine flow chart showing the process for determining throttle opening command value in the flow chart of FIG. 5.

FIG. 12 is a subroutine flow chart showing the processing conducted in S26.

First, in S500, the computed opening command value (angular steps) is compared with the physical upper limit value (first predetermined value) of the throttle valve 40 (100 angular steps) to determine whether the computed opening command value is greater than the physical upper limit value. When the result is YES, the program proceeds to S502, in which the opening command value is replaced by the physical upper limit value and the replaced one is determined as the output throttle opening command value.

When the result in S500 is NO, the program proceeds to S504, in which the computed opening command value is compared with the physical lower limit value (second predetermined value) of the throttle valve 40 (0 angular step) to determine whether the computed opening command value is smaller than the physical lower limit value. When the result is YES, the program proceeds to S506, in which the opening command value is replaced by the physical lower limit value and the replaced one is determined as the output throttle command value.

When the result in S504 is NO, the computed value is immediately determined to be output throttle opening command value. In other words, at least one of the replaced value and the computed throttle opening command value is determined as the output throttle command value.

This will be explained. The throttle valve 40 in the actual general-purpose engine 10 has physical upper and lower limit values. When the computed opening command value exceeds either of these limits, the control system is no longer valid.

As mentioned earlier, the stepper motor 46 operates between 0 angular step indicating a full-closed equivalent position and 100 angular steps indicating a wide-open equivalent position. As was explained regarding the throttle position (opening) initialization processing, in order to prevent sticking, a value that is set a prescribed amount, e.g., around 2 degrees, in the opening direction is preferably used as the lower limit opening. Similarly, with regard to the wide-open equivalent position, since it is meaningless to open the throttle valve 40 beyond the opening at which the output of the engine 10 is maximum and is saturated, the opening at which the output of the engine becomes maximum is preferably used as the upper limit opening.

In most general-purpose engines, a mechanical stop is used to define the full-closed equivalent position about this far in the open direction, while the wide-open equivalent position is not adjusted but left as is.

Since the control system for a general-purpose engine of this embodiment is configured to control of the opening of the throttle valve 40 using the stepper motor 46 connected thereto, the wide-open equivalent position is defined by experimentally determining the opening at which the engine output becomes maximum and defining the angular step of this opening as 100, the full-closed equivalent position is set at 2 degrees defined as 0, and a check is made as to whether or not the computed opening command value is within this range. Since this embodiment is thus configured to restrict the opening command value that the adaptive control computation determines for supply to the stepper motor 46 to within physical limit values, an adaptive control system can be structured that is robust with respect to change in the characteristic of the subject of control (plant).

The throttle opening command value thus determined is then supplied to the stepper motor (actuator) 46 through the motor driver 54.

The control that remains to be conducted by the ECU 50 will now be explained.

Figure 13:
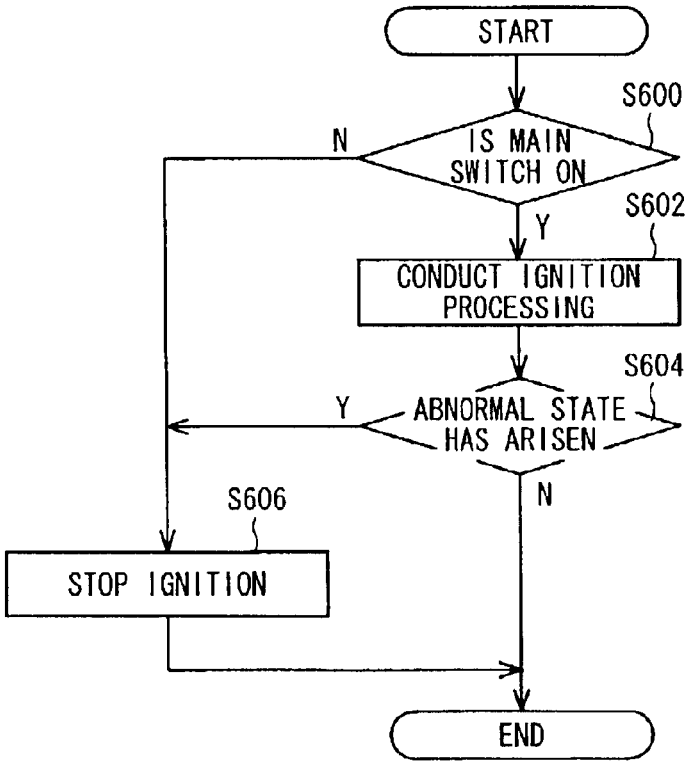
FIG. 13 is a flow chart showing ignition control that remains to be conduced by the ECU of the system of FIG. 1.

FIG. 13 is a flow chart showing ignition control conducted by the ECU 50. Like the routine of FIG. 5, this routine is also executed once every 10 msec.

First, in S600, it is checked whether the main SW (switch) is ON. When the result is YES, the program proceeds to S602, in which ignition processing is conducted. As explained earlier, this is for effecting ignition at a fixed crank angle such as BTDC 10 degrees.

The program then proceeds to S604, in which it is checked whether an abnormal state has arisen. This is determined from the output of the ignition processing/overspeed detection unit 106 explained above. Specifically, the ECU 50 compares the detected engine speed NE with a permissible value in another routine (not shown) and outputs an overspeed finding when the detected engine speed NE exceeds the permissible value. The check in S604 is made based on this output.

When the result in S604 is YES, the program proceeds to S606, in which the ignition is stopped or cut off. This immediately stops the engine to prevent overspeed. When the result in S604 is NO, the remaining processing is skipped.

The embodiment is thus configured to have a system for controlling a general-purpose spark-ignition internal combustion engine (10) having one or two cylinders (12) and an actuator (46) connected to the throttle valve (40) to open or close the throttle value, which introduces an air-fuel mixture produced in a carburetor (42) by mixing gasoline fuel and intake air regulated by the throttle valve into the cylinder to be ignited. The system comprising; engine speed detecting means (48, 50, 100, S14, S100–S104) for detecting a speed of the engine (NE); desired engine speed determining means (50, 102, S18, 200–S210) for determining a desired speed of the engine (NEM); an adaptive controller (50, 112, 104, S24) with a parameter identification mechanism (50, 110), which receives the detected engine speed and the desired engine speed as inputs, and computes a command value to be supplied to the actuator, using an adaptive parameter (θ-hat) identified by the parameter identification mechanism, such that the detected engine speed is brought to the desired speed; and command value determining means (50, S26, S500–S506) for determining an output command value based on the command value computed by the adaptive controller and supplying the output command value to the actuator. With this, the amount of computation increases, but, owing to the fact that the gain can be set without taking load into account, robust control can be achieved with respect to changes in a characteristic of subject of control (plant). Another advantage is that the utilized engine speed can be set freely.

In the system, the desired engine speed determining means determines the desired engine speed such that the desired engine speed per unit time is not greater than a prescribed value (NE1, NE2). With this, the change in the desired engine speed per unit time is limited to not greater than a prescribed value. Therefore, sudden changes in the desired engine speed can be avoided and no overshooting of the change in the desired engine speed or control hunting occurs despite the low responsivity of the fuel control owing to the use of the carburetor.

In the system, the prescribed value (NE1, NE2) is set to be different in an engine speed increase direction and in an engine speed decrease direction in such a way that the prescribed value in the engine speed increase direction is set to be greater than that in the engine speed decrease direction. With this, different prescribed values are set in the engine speed increase and decrease directions and that in the increase direction is set greater than that in the decrease direction. Approximately the same responsivity can therefore be obtained with respect to both desired engine speed increase and decrease demands. This matching of the prescribed values to the engine responsivity makes it possible to achieve improved control accuracy.

In the system, the command value determining means includes; first comparing means (50, S500, S502) for comparing the command value with a first predetermined value and when the command value is greater than the first predetermined value, for replacing the command value by the first prescribed value; second comparing means for comparing the command value with a second predetermined value (50, S504, S506) and when the command value is smaller than the second predetermined value, for replacing the command value by the second predetermined value; and determines at least one of the replaced value and the computed command value as the output command value. In the system, the first predetermined value is a value set prescribed amount in opening direction from the full-closed position of the throttle valve (40). With this, it becomes possible to determine the output command value within physical upper and lower limits, thereby enabling to achieve a robust control.

In the system, the engine speed detecting means includes; a crank angle sensor (48) provided at the engine which generates output at predetermined crank angle intervals; and smoothed value calculating means (50, S14, S106–S104) for calculating a smoothed value of the outputs of the crank angle sensor for a predetermined number of the outputs; and detects the engine speed (NE) based on the smoothed value. The predetermined number is a value corresponding to an integral number of combustion cycle of the engine. With this, it becomes possible to determine the command value without being affected by the fluctuation of the engine speed, thereby ensuring to achieve a robust control.

The system further includes gain determining means (50, S22, S400–S410) for determining a gain (γ) that determines an identification speed of the adaptive parameter based on a deviation (ΔNE) of the detected engine speed (NE) and the desired engine speed. (NEM). The gain determining means includes: deviation calculating means (50, S400) for calculating the deviation by subtracting the detected engine speed from the desired engine speed; first comparing means (50, S402) for comparing the calculated deviation with a first reference value (NE3) in positive value; first gain setting means (S404) for setting the gain to a first value, when the deviation is found to be greater than the first reference value; second comparing means (S406) for comparing the calculated deviation with a second reference value (NE4) in negative value; second gain setting means (S408) for setting the gain to a second value, when the deviation is found to be smaller than the second reference value; and third gain setting means (S410) for setting the gain to a third value, when the deviation is found to be not greater than the first reference value and is not smaller than the second reference value. The first value is set to be larger than the second value. In the system, the third value is a value at a situation where the detected engine speed is near the desired engine speed, and the first and second values are set to be larger than the third value. With this, it becomes possible to determine the gain appropriately such that the convergence and responsivity of control are optimally balanced.

The system further includes control cycle determining means (50, S300–S308) for determining a control cycle of the adaptive controller based on a value obtained by dividing 1 minute by the detected engine speed, and ignition stopping means (50, S600–S606) for stopping ignition of the engine when the detected engine speed exceeds a permissible range.

Although a stepper motor was exemplified as the actuator in the foregoing, the actuator is not limited to a stepper motor and the degree of throttle opening can instead be regulated using a linear solenoid, DC motor or the like.

The entire disclosure of Japanese Patent Application Nos. 2001-287323, 2001-287324, 2001-2887325 and 2001-287326 all filed on Sep. 20, 2001, including specification, claims, drawings and summary, is incorporated herein in reference in its entirety.

While the invention has thus been shown and described with reference to specific embodiments, it should be noted that the invention is in no way limited to the details of the described arrangements; changes and modifications may be made without departing from the scope of the appended claims.

What is claimed is:

1. A system for controlling a general-purpose spark-ignition internal combustion engine having one or two cylinders and an actuator connected to the throttle valve to open or close the throttle value, which introduces an air-fuel mixture produced in a carburetor by mixing gasoline fuel and intake air regulated by the throttle valve into the cylinder to be ignited, comprising:

engine speed detecting means for detecting a speed of the engine;

desired engine speed determining means for determining a desired speed of the engine;

an adaptive controller with a parameter identification mechanism, which receives the detected engine speed and the desired engine speed as inputs, and computes a command value to be supplied to the actuator, using an adaptive parameter identified by the parameter identification mechanism, such that the detected engine speed is brought to the desired speed; and command value determining means for determining an output command value based on the command value computed by the adaptive controller and supplying the output command value to the actuator.

2. A system according to claim 1, wherein the desired engine speed determining means determines the desired engine speed such that the desired engine speed per unit time is not greater than a prescribed value.

3. A system according to claim 2, wherein the prescribed value is set to be different in an engine speed increase direction and in an engine speed decrease direction in such a way that the prescribed value in the engine speed increase direction is set to be greater than that in the engine speed decrease direction.

4. A system according to claim 1, the command value determining means includes;

first comparing means for comparing the command value with a first predetermined value and when the command value is greater than the first predetermined value, for replacing the command value by the first prescribed value;

second comparing means for comparing the command value with a second predetermined value and when the command value is smaller than the second predetermined value, for replacing the command value by the second predetermined value;

and determines at least one of the replaced value and the computed command value as the output command value.

5. A system according to claim 4, wherein the first predetermined value is a value set prescribed amount in opening direction from the full-closed position of the throttle valve.

6. A system according to claim 1, wherein the engine speed detecting means includes;

a crank angle sensor provided at the engine which generates output at predetermined crank angle intervals; and smoothed value calculating means for calculating a smoothed value of the outputs of the crank angle sensor for a predetermined number of the outputs;

and detects the engine speed based on the smoothed value.

7. A system according to claim 6, wherein the predetermined number is a value corresponding to an integral number of combustion cycle of the engine.

8. A system according to claim 1, further including:

gain determining means for determining a gain that determines an identification speed of the adaptive parameter based on a deviation of the detected engine speed and the desired engine speed.

9. A system according to claim 8, wherein the gain determining means includes:

deviation calculating means for calculating the deviation by subtracting the detected engine speed from the desired engine speed;

first comparing means for comparing the calculated deviation with a first reference value in positive value;

first gain setting means for setting the gain to a first value, when the deviation is found to be greater than the first reference value;

second comparing means for comparing the calculated deviation with a second reference value in negative value;

second gain setting means for setting the gain to a second value, when the deviation is found to be smaller than the second reference value; and third gain setting means for setting the gain to a third value, when the deviation is found to be not greater than the first reference value and is not smaller than the second reference value.

10. A system according to claim 9, wherein the first value is set to be larger than the second value.

11. A system according to claim 10, wherein the third value is a value at a situation where the detected engine speed is near the desired engine speed, and the first and second values are set to be larger than the third value.

12. A system according to claim 1, further including control cycle determining means for determining a control cycle of the adaptive controller based on a value obtained by dividing 1 minute by the detected engine speed.

13. A system according to claim 1, further including:

ignition stopping means for stopping ignition of the engine when the detected engine speed exceeds a permissible range.

14. A method controlling a general-purpose spark-ignition internal combustion engine having one or two cylinders and an actuator connected to the throttle valve to open or close the throttle value, which introduces an air-fuel mixture produced in a carburetor by mixing gasoline fuel and intake air regulated by the throttle valve into the cylinder to be ignited, comprising the steps of:

detecting a speed of the engine;

determining a desired speed of the engine;

adaptive controlling with a parameter identification, while receiving the detected engine speed and the desired engine speed as inputs, and computing a command value to be supplied to the actuator, with use of an adaptive parameter identified, such that the detected engine speed is brought to the desired speed; and determining an output command value based on the command value computed by the adaptive controller and supplying the output command value to the actuator.

15. A method according to claim 14, wherein the step of desired engine speed determining determines the desired engine speed such that the desired engine speed per unit time is not greater than a prescribed value.

16. A method according to claim 15, wherein the prescribed value is set to be different in an engine speed increase direction and in an engine speed decrease direction in such a way that the prescribed value in the engine speed increase direction is set to be greater than that in the engine speed decrease direction.

17. A method according to claim 14, the step of command value determining includes the steps of;

comparing the command value with a first predetermined value and when the command value is greater than the first predetermined value, for replacing the command value by the first prescribed value;

comparing the command value with a second predetermined value and when the command value is smaller than the second predetermined value, for replacing the command value by the second predetermined value;

and determines at least one of the replaced value and the computed command value as the output command value.

18. A method according to claim 17, wherein the first predetermined value is a value set prescribed amount in opening direction from the full-closed position of the throttle valve.

19. A method according to claim 14, wherein the step of engine speed detecting includes the step of;

smoothed value calculating means for calculating a smoothed value of outputs of a crank angle sensor for a predetermined number of the outputs;

and detects the engine speed based on the smoothed value.

20. A method according to claim 19, wherein the predetermined number is a value corresponding to an integral number of combustion cycle of the engine.

21. A method according to claim 14, further including the step of:

determining a gain that determines an identification speed of the adaptive parameter based on a deviation of the detected engine speed and the desired engine speed.

22. A method according to claim 21, wherein the step of gain determining includes the steps of:

calculating the deviation by subtracting the detected engine speed from the desired engine speed;

comparing the calculated deviation with a first reference value in positive value;

setting the gain to a first value, when the deviation is found to be greater than the first reference value;

comparing the calculated deviation with a second reference value in negative value;

setting the gain to a second value, when the deviation is found to be smaller than the second reference value; and setting the gain to a third value, when the deviation is found to be not greater than the first reference value and is not smaller than the second reference value.

23. A method according to claim 22, wherein the first value is set to be larger than the second value.

24. A method according to claim 22, wherein the third value is a value at a situation where the detected engine speed is near the desired engine speed, and the first and second values are set to be larger than the third value.

25. A method according to claim 14, further including the step of;

determining a control cycle of the adaptive controller based on a value obtained by dividing 1 minute by the detected engine speed.

26. A method according to claim 14, further including the step of:

stopping ignition of the engine when the detected engine speed exceeds a permissible range.

* * * * *